US008864268B2

(12) United States Patent
Tanase et al.

(10) Patent No.: US 8,864,268 B2
(45) Date of Patent: Oct. 21, 2014

(54) PRINTING APPARATUS AND PRINTING METHOD

(75) Inventors: Kazuyoshi Tanase, Nagano (JP); Toru Takahashi, Nagano (JP); Takamitsu Kondo, Nagano (JP); Hiroshi Wada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 215 days.

(21) Appl. No.: 13/427,201

(22) Filed: Mar. 22, 2012

(65) Prior Publication Data

US 2012/0242728 A1 Sep. 27, 2012

(30) Foreign Application Priority Data

Mar. 23, 2011 (JP) ..... 2011-064384

(51) Int. Cl.

| | |
|---|---|
| ***B41J 29/38*** | (2006.01) |
| ***B41J 2/01*** | (2006.01) |
| ***B41J 3/407*** | (2006.01) |
| ***B41J 11/00*** | (2006.01) |
| ***B41J 25/32*** | (2006.01) |
| *B41M 5/00* | (2006.01) |

(52) U.S. Cl.

CPC ..... *B41J 11/0015* (2013.01); *B41J 25/32* (2013.01); *B41J 11/002* (2013.01); *B41M 5/0011* (2013.01); *B41M 5/0088* (2013.01)

USPC ..... 347/16; 347/102; 347/106

(58) Field of Classification Search

CPC ..... B41J 11/02

See application file for complete search history.

(56) References Cited

U.S. PATENT DOCUMENTS

| | | | | |
|---|---|---|---|---|
| 7,152,970 | B2 * | 12/2006 | Hasebe et al. | 347/102 |
| 2006/0284953 | A1 * | 12/2006 | Hatasa et al. | 347/105 |
| 2009/0244175 | A1 * | 10/2009 | Kojima | 347/33 |

FOREIGN PATENT DOCUMENTS

| | | | |
|---|---|---|---|
| JP | 2004042548 | A * | 2/2004 |
| JP | 4321050 | B2 | 8/2009 |

* cited by examiner

*Primary Examiner* — Shelby Fidler
*Assistant Examiner* — Tracey McMillion
(74) *Attorney, Agent, or Firm* — Global IP Counselors, LLP

(57) ABSTRACT

To prevent uneven gloss on a printed image in a printing apparatus in which light-curable ink is used, a printing apparatus is provided. The printing apparatus includes a controller controls medium-conveying parts for conveying a medium so that the medium supplied from an upstream side is released on a downstream side; nozzles for discharging ink droplets cured by light irradiation onto the medium; a light-irradiation part for irradiating the medium with light; and medium-deforming parts arranged on the downstream side of the nozzles, holding the medium from the front and back, and deforming the medium so that an irregular shape is formed in cross section; the medium is conveyed downstream by the medium-conveying parts after the medium is deformed by the medium-deforming parts; droplets of ink are discharged from the nozzles to form an image on the surface of the medium; and the ink droplets discharged onto the medium are irradiated with light by the light-irradiation part to cure the droplets.

6 Claims, 9 Drawing Sheets

PRINTING APPARATUS AND PRINTING METHOD

CROSS-REFERENCE TO RELATED APPLICATIONS

This application claims priority to Japanese Patent Application No. 2011-064384 filed on Mar. 23, 2011. The entire disclosure of Japanese Patent Application No. 2011-064384 is hereby incorporated herein by reference.

BACKGROUND

1. Technical Field

The present invention relates to a printing apparatus in which ink cured by irradiation with light is used. The invention also relates to a method for preventing uneven gloss on an image printed using the printing apparatus.

2. Background Technology

Inkjet printers for discharging ink onto a medium to form an image belong to the class of printing apparatuses. In such of these inject printers, images are printed using light-curable ink that is irradiated with ultraviolet light or other light and cured (for example, refer to Patent Citation 1). In inkjet printers that use such light-curable ink, the occurrence of bleeding (running) caused by combinations of ink droplets can be suppressed by curing the ink droplets discharged on the medium with light.

Japanese Patent Registration No. 4321050 (Patent Citation 1) is an example of the related art.

SUMMARY

Problems to be Solved by the Invention

In inkjet printers in which light-curable ink is used, a problem arises in which unevenness in gloss level occurs in correspondence with the amount of ink per unit area on the medium. For example, the gloss level is low in sections in which the amount of ink is sparse, such as those displaying the color of skin or the like. Conversely, the amount of ink is considerable and the gloss level is high in solidly filled sections such as those of a pupil or the like. Therefore, in a case in which a human face is the printed image, the gloss levels vary according to the position on the face, resulting in an unnatural image.

An advantage of the invention is to provide a printing apparatus capable of printing an image having even gloss levels even when the amount of ink is unevenly distributed on the medium. Additional advantages will be described below.

Means Used to Solve the Above-Mentioned Problems

The primary invention, which was devised to achieve the aforementioned advantage, provides a printing apparatus for depositing ink droplets on a surface of a medium to form an image;

the printing apparatus including:

including a medium-conveying part, nozzles, a light-irradiation part, a medium-deforming part, and a controller for controlling the parts;

the medium-conveying part conveying the medium so that the medium supplied from an upstream side is released on a downstream side;

the nozzles discharging ink droplets curable by light irradiation onto the medium;

the light-irradiation part irradiating the medium with light;

the medium-deforming part being arranged on the downstream side of the nozzles, holding the medium from the front and back, and deforming the medium so that an irregular shape is formed in cross section;

the controller performing a medium-deforming step, an image-forming step, and a light-irradiating step;

in the medium-deforming step, the medium being conveyed downstream by the medium-conveying part after the medium is deformed by the medium-deforming part;

in the image-forming step, the ink droplets being discharged by the nozzles to form an image on the surface of the medium; and in the light-irradiating step, the ink droplets discharged onto the medium being irradiated with light by the light-irradiation part to cure the droplets.

Other characteristics of the invention are made apparent from the descriptions of the specification and the attached drawings.

BRIEF DESCRIPTION OF THE DRAWINGS

Referring now to the attached drawings which form a part of this original disclosure.

DETAILED DESCRIPTION OF EXEMPLARY EMBODIMENTS

Gloss Level

The gloss level of a printed image is dependent on the state of the light reflected from a medium struck by natural light. For example, the gloss level is low when the reflected light is diffused; this state is referred to as "matte." Conversely, a high gloss level can be obtained when the light approaches specular reflection; this state is referred to as "glossy." Unevenness in the gloss level of printed images occurs in inkjet printers in which light-curable ink is used, as described above. In general terms, gloss level is dependent on the amount of ink per unit area on the medium, that is, on the amount of ink droplets (ink drops) sprayed onto the medium.

Figure 1A:
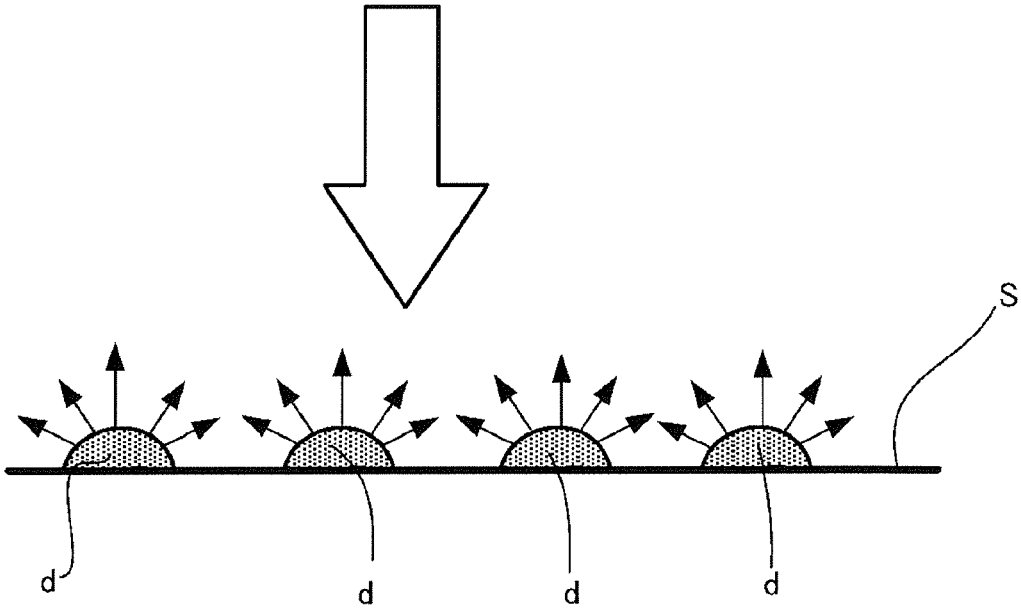
FIG. 1 is a view showing the principle by which uneven gloss occurs on an image printed by an inkjet printer in which light-curable ink is used.

FIG. 1 is a schematic view showing uneven gloss on an image printed by an inkjet printer in which light-curable ink is used. For example, in a case in which a human face is printed as an image, the cheeks or other parts are a pale skin color. The amount of ink droplets (ink drops) "d" impinging on a printed area having this pale color is small. The ink drops "d" are cured by ultraviolet light (UV) or other light, and independent islets having a shape resembling a hemisphere are therefore formed without the blurring of the ink drops "d" on a medium S, as shown in FIG. 1A. Specifically, the density of the ink drops "d" is "sparse." Accordingly, light (white arrow in the drawing) incident on the surface of the medium S is reflected (solid arrows in the drawing) in various directions by the surface of the islet-shaped ink drops "d". Specifically, diffuse reflection results.

Figure 1B:
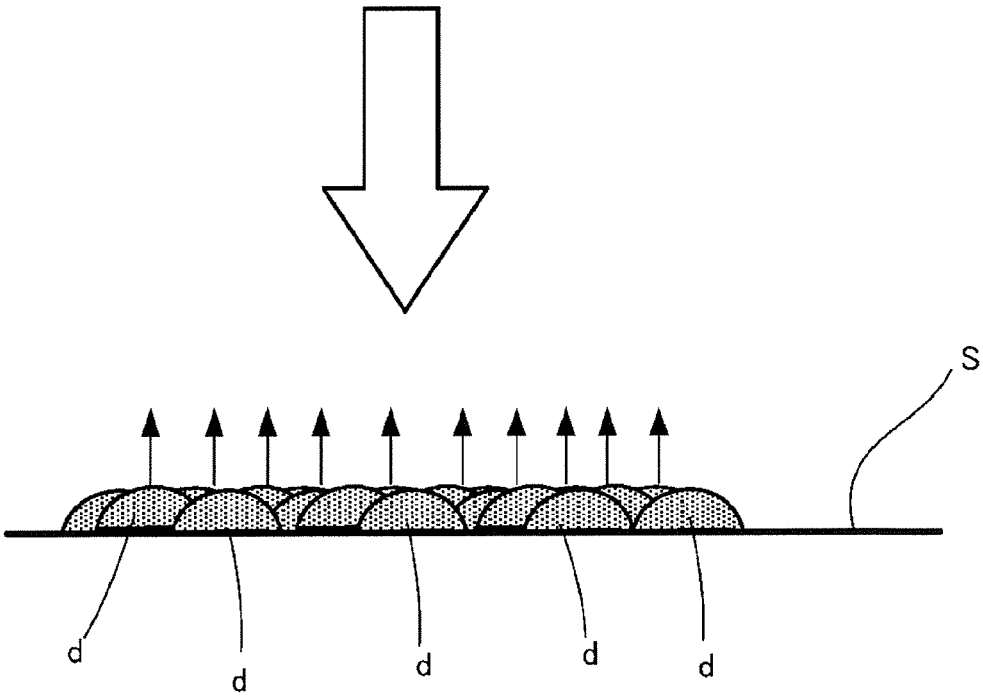

In contrast, the pupil or other dark-colored section is expressed by entirely filling the image area, as shown in FIG. 1B. Specifically, the adjacent ink drops "d" are densely arranged in the image area, resulting in a state that is similar to one in which a film-like ink covers the medium S, even if individual ink drops "d" have a hemispherical shape. Incident light is therefore reflected in a substantially specular manner by the film-shaped ink surface, and the gloss level increases. Accordingly, in human faces and the like, cheeks and other sections having skin are matte, and sections having pupils are glossy, resulting in an unnatural image lacking uniformity in gloss level.

Figure 2:
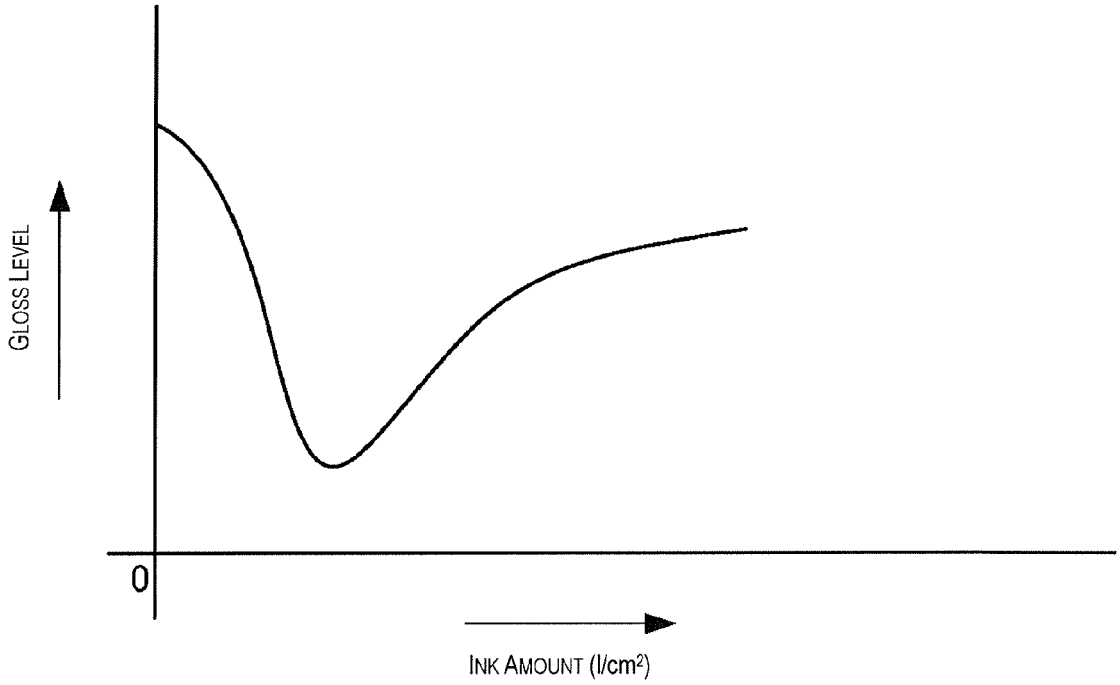
FIG. 2 is a view showing the relationship between the amount of ink per unit area on a medium and the gloss level.

The aforementioned is a summary of causes of uneven gloss. However, the mechanism for producing uneven gloss schematically shown in FIG. 1 is a model that has been simplified to a certain degree; in reality, uneven gloss does not simply depend exclusively on the density of the ink drops "d". FIG. 2 shows the relationship between the density of ink on the medium S and the gloss level. The drawing shows the relationship between the amount of ink (volume) per unit area on the medium S and the gloss level measured using a known gloss meter (gloss checker). The gloss level of the medium S is reflected when the amount of ink is very low, and the diffuse reflection component caused by the sparsely arranged ink drops "d" increases with an increased amount of ink, causing a decrease in the gloss level. The specular reflection component increases in relative terms when the amount of ink per unit area exceeds a designated amount, shifting the gloss level toward higher levels. In addition, the gloss level differs depending on the type of the medium S, and the relationship between the amount of ink and the gloss level therefore becomes more complicated when different types of mediums S are used for various purposes.

Embodiments of the Invention

As described above, uneven gloss occurs due to the density of the ink drops on the medium in a printer in which light-curable ink is used. Moreover, the density of ink drops and the gloss level are not in a simple proportional relationship, making it impossible for the uneven gloss on the same medium to be eliminated by simply making the gloss level uniform over the entire image by using glossy paper, matte paper, or another surface-treated medium. Reforming the ink is a consideration, but the physical properties related to the gloss level of the ink must be optimized without losing the original characteristic of the light-curable ink, that is, the ability to suppress bleeding. Furthermore, the ink discharge method and the like suitable to the physical properties of the ink must also be optimized. The development and research of ink, discharge control, and other peripheral technologies therefore require extensive time and cost to develop. In view of this, a goal was set to achieve a uniform gloss level in matte, that is, to change the technical thinking, by physically modifying the cross-sectional shape of the medium rather than by reforming the ink or surface-treating the medium.

The printing apparatus according to this embodiment can be provided with the below-described characteristics in addition to the characteristics provided by an embodiment corresponding to the primary aspect of the invention.

The medium-deforming part is configured from rollers for holding the medium while being orthogonal to the conveying direction of the medium, and irregularities are formed on the surface of one of the rollers. In this case, the surface of the medium on which the ink droplets are deposited is the front surface, the roller provided with irregularities is arranged facing the rear surface of the medium, and the roller provided with an elastic surface and formed from a material lacking any irregularities is arranged facing the front surface.

In addition, the printing apparatus is provided, wherein:

the light-irradiation part arranged downstream of a head part further includes a temporary-curing irradiation part on the upstream side, and a permanent-curing irradiation part on the downstream side;

the controller performs a temporary curing step and a permanent curing step;

the temporary-curing irradiation part irradiates light for preventing the flow of the ink droplets;

the permanent-curing irradiation part irradiates light having higher energy in comparison with the light irradiated by the temporary-curing irradiation part;

in the temporary curing step, the ink droplets deposited on the medium by the nozzles are irradiated with light by the temporary-curing irradiation part; and in the permanent curing step, the ink droplets irradiated with light in the temporary curing step are irradiated with light, cured, and fixed to the medium.

An example of the invention further provides a printing method using a printing apparatus in which light-curable ink is discharged as droplets from nozzles and deposited on a medium, the deposited droplets are irradiated with light and cured, and an image composed of minute dots is formed on the medium; the printing method wherein the printing apparatus performs a step for deforming the medium so that an irregular shape is formed in cross section before the image-forming step is performed.

Basic Configuration and Operation of Printer

Figure 3:
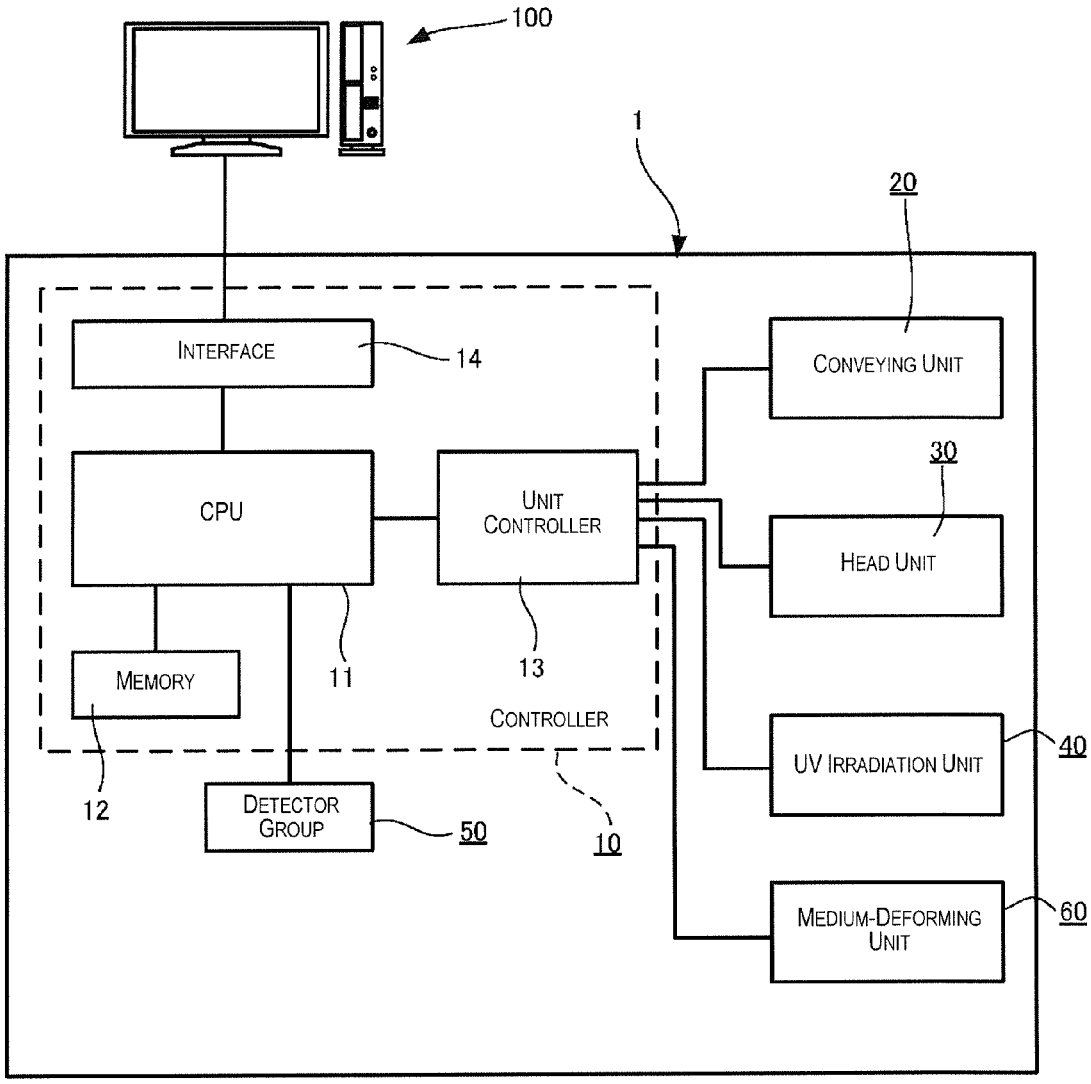
FIG. 3 is a block diagram of a printer according to an embodiment of the invention.
Figure 4:
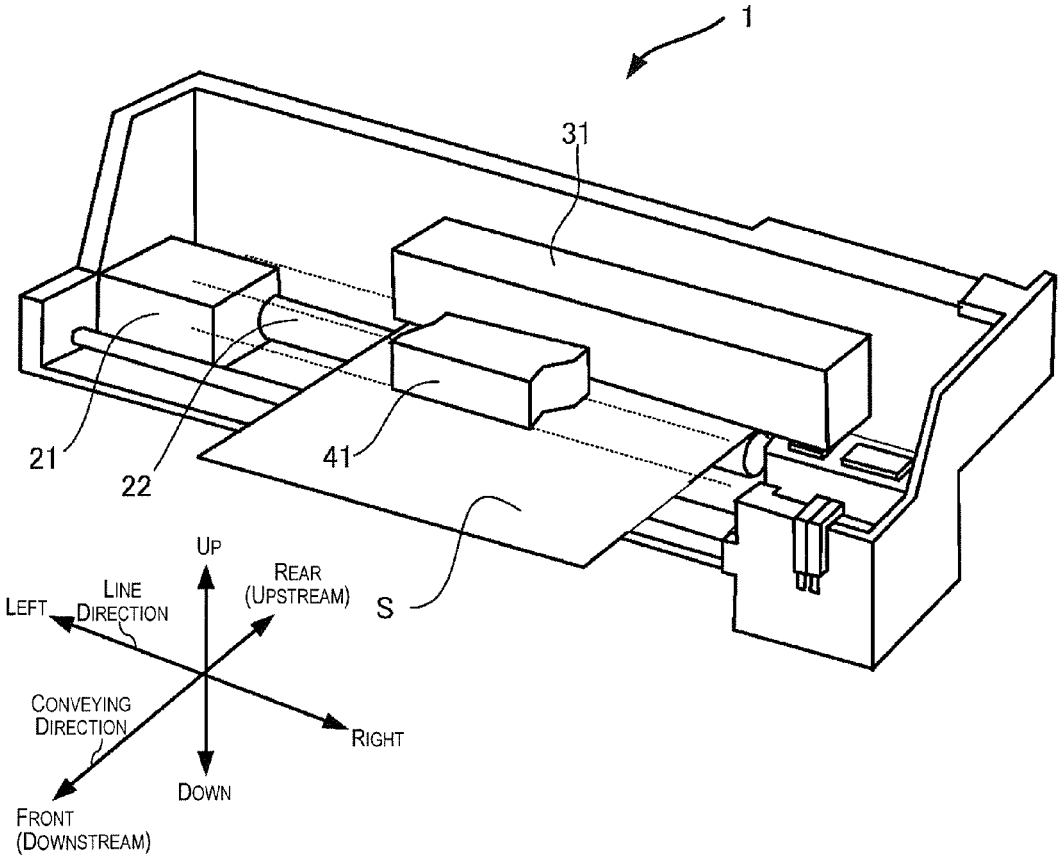
FIG. 4 is a cutaway perspective view of the printer in the embodiment.

An inkjet printer (hereinafter referred to as a "UV printer") of a type in which UV ink is cured by ultraviolet irradiation is given as a more specific embodiment of the invention. The overall configuration of the UV printer 1 according to this embodiment is shown in FIG. 3 as a block diagram. In addition, a schematic configuration of the UV printer 1 is shown as a cutaway perspective view of the UV printer 1 as viewed from above front. The basic configuration and operation of the UV printer 1 according to an embodiment of the invention are described herein on the basis of FIGS. 3 and 4, and on the basis of appropriate drawings shown below.

A controller 10 is a control unit for controlling the UV printer 1. The controller includes a CPU 11 as a processor-controller, a memory 12 having a storage area for a program performed by the CPU 11 and an operating area for the program, a unit controller 13 for controlling the operation of individual units (20 to 60), an interface (IF) 14 for transmitting data between a computer 100, which is an external device, and the CPU 11, and the like.

Figure 5:
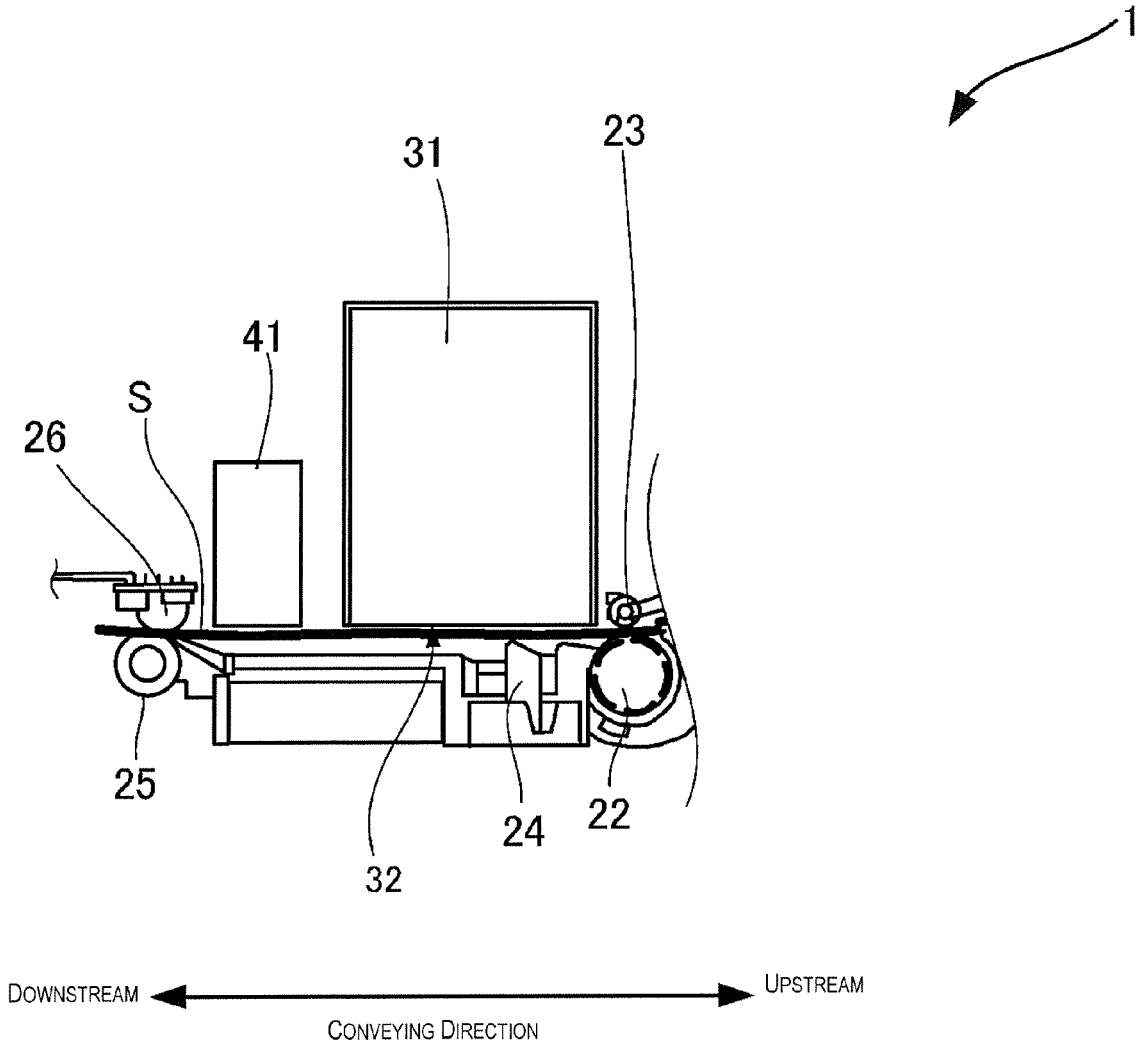
FIG. 5 is a view showing a schematic configuration of a medium-conveying mechanism of the printer in the embodiment.

A conveying unit 20 includes a mechanism or circuit for conveying paper or another medium S in a designated direction. In this example, the rearward direction of the UV printer 1 is upstream, the frontward direction is downstream, and the medium S is conveyed so as to be supplied from the upstream side and released from the downstream side. FIG. 5 shows a schematic configuration of the mechanism for conveying the medium S in the conveying unit 20. Using the conveying mechanism, the medium S inserted into an insertion opening for the medium S is fed into the UV printer 1 by a feed roller (not shown), a conveying roller 22 rotatably driven by a conveying motor 21 sandwiches the medium S together with a driven roller 23, and the medium S is conveyed to an area where printing can be performed. In addition, the medium S is conveyed during printing toward downstream while being supported by a platen 24. An ejecting roller 25 that rotates in synch with the conveying roller 22 sandwiches the printed medium S together with the driven roller 26 and releases the medium S to the downstream side.

A detector group 50 includes sensors for detecting the various states inside of the UV printer 1, each of the sensors included in the detector group 50 outputs the detection results (detection data) to the controller 10, and the controller 10 performs feedback control on each of the units on the basis of the detection data. The detector group 50 can, for example, include a rotary encoder for detecting the rotations of the conveying roller 22, and other sensors.

Figure 6:
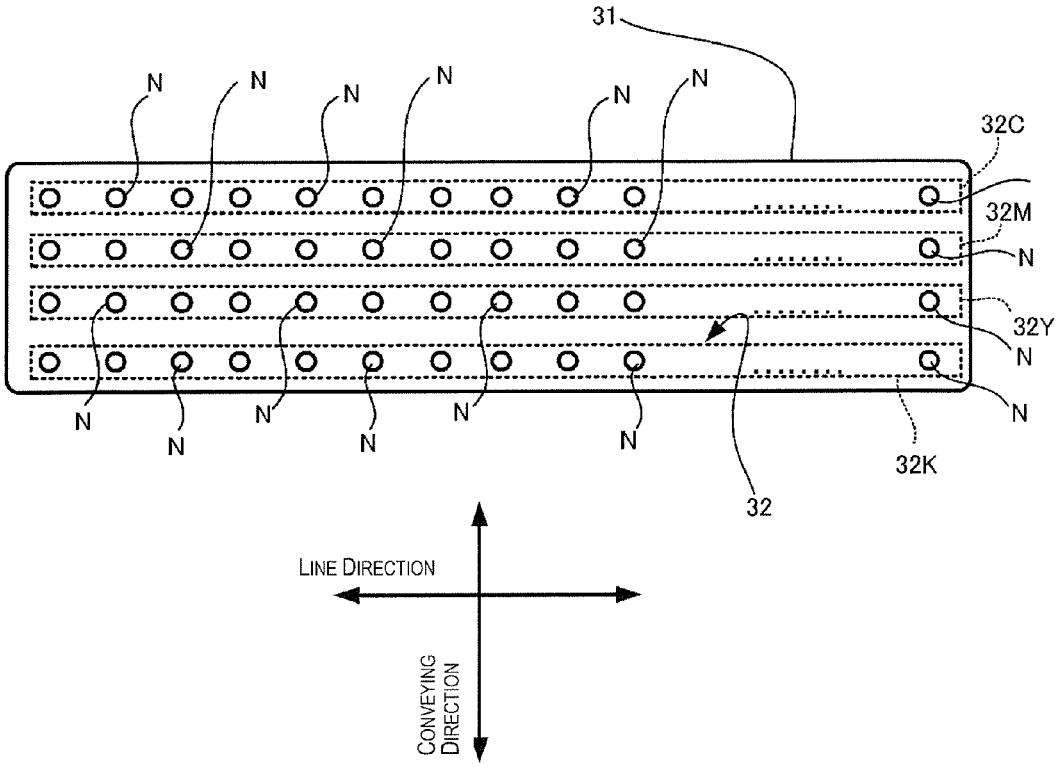
FIG. 6 is a view showing nozzle rows of a head of the printer in the embodiment.
Figure 7A:
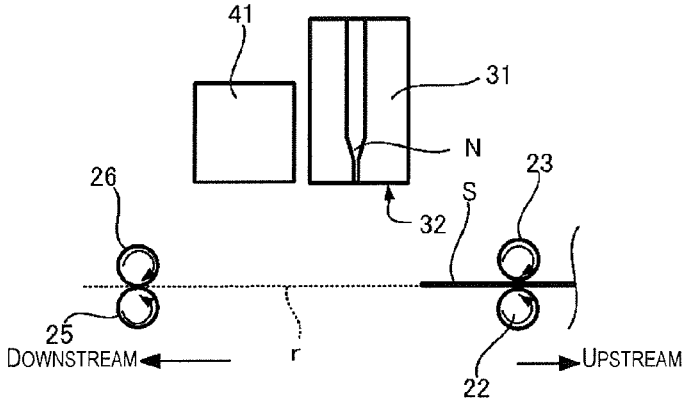
FIG. 7 is a view showing the printing operation of the printer in the embodiment.
Figure 7B:
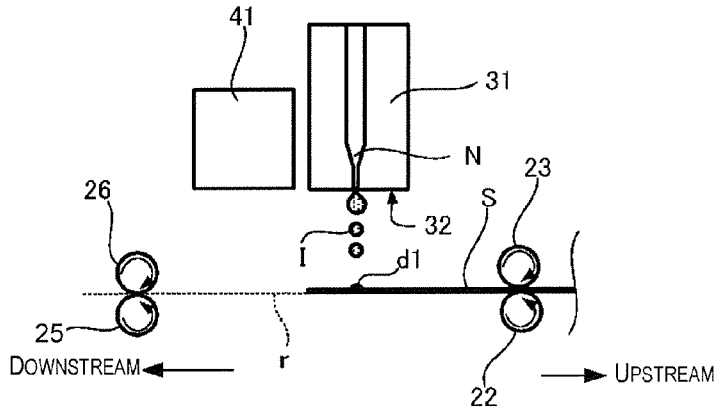
Figure 7C:
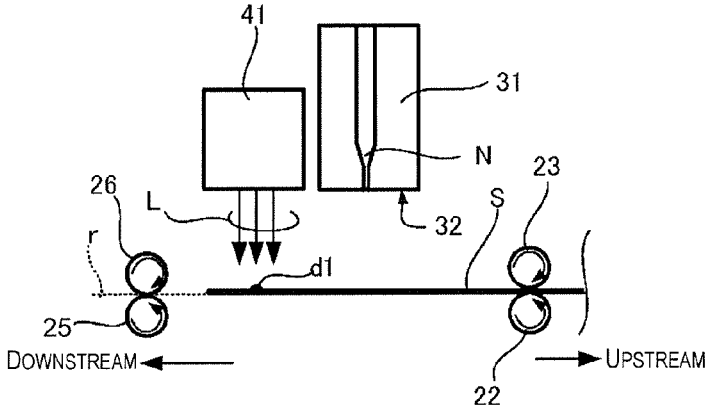
Figure 7D:
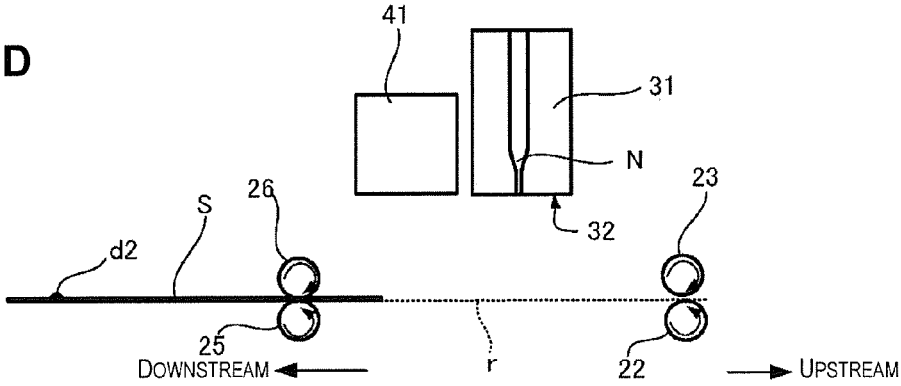

A head unit 30 is adapted to discharge ink toward the medium S, and is configured so as to include, in addition to a nozzled head 31, ink tanks, a pump for supplying ink to the head 31 from the ink tanks, and the like. The UV printer 1 shown here is a line printer arranged so that the head 31 provided with ink-discharging nozzles on the lower surface 32 thereof extends in the widthwise direction (hereinafter referred to as the "line direction") orthogonal to the conveying direction of the medium S. Multicolored ink for multicolor printing is loaded into individual ink tanks. An example of the nozzle arrangement of the head 31 is shown in FIG. 6. A plurality of nozzles N opens in a side-by-side arrangement at regular intervals in the line direction on the lower surface 32 of the head 31, and nozzle rows (33C, 33M, 33Y, 33K) are formed on the surface. The nozzle rows (33C, 33M, 33Y, 33K) are lined up at regular intervals in the conveying direction, and each of the nozzle rows (33C, 33M, 33Y, 33K) corresponds to an ink of a different color. A cyan ink nozzle row 33C, a magenta ink nozzle row 33M, a yellow ink nozzle row 33Y, and a black ink nozzle row 33K are formed in this example.

Each of the nozzles N is provided with an ink chamber (not shown) and a piezo element. Ink drops are discharged from the nozzles N when the ink chambers are expanded and contracted by the driving of the piezo elements. An image in which dots made of ink drops are arranged in two dimensions on the medium S is formed on the medium S when the head 31 intermittently discharges ink drops during conveyance of the medium S by the control of the controller 10.

A UV irradiation unit 40 includes a metal-halide lamp or other UV light source for irradiating ultraviolet light to cure UV ink, and a drive circuit or the like for lighting the UV light source. A UV light source 41 is provided so as to be arranged on the downstream side in the conveying direction in relation to the head 31 and to extend in the line direction. The irradiation range of ultraviolet light is an area longer than the width of the medium S, which is the print target. The UV irradiation unit 40 causes the UV light source 41 to light up toward the medium S when the medium S is moved in the conveying direction by the control of the controller 10. The UV ink drops on the medium S are thereby cured.

FIGS. 7A to 7D show the printing procedure in the UV printer 1. The drawings show part of a conveying route "r" of the medium S. The conveying unit 20 conveys the medium S to the print area by the conveying roller 22 and the driven roller 23 in accordance with the control of the controller 10 A, the head unit 30 discharges ink I from the nozzles N of the head 31 toward the medium S, and ink drops d1 are deposited on the medium S (B). The UV light source 41 irradiates the ink drops d1 with ultraviolet light L, and the UV ink drops d1 on the medium S are cured. An image based on the cured UV ink drops d2 is thereby formed. The conveying unit 20 then releases the medium S from the printer 1 by the ejecting roller 25 and a driven roller 26 (D).

Function for Preventing Uneven Gloss

As described above, uneven gloss is produced in UV printers due to the amount of ink per unit area on the medium. The UV printer 1 according to the present embodiment is provided with a medium-deforming unit 60 as a configuration bearing the function for preventing uneven gloss. The operation of the function for preventing uneven gloss in the UV printer 1 of this embodiment is described hereinafter as an example of the invention.

Figure 8:
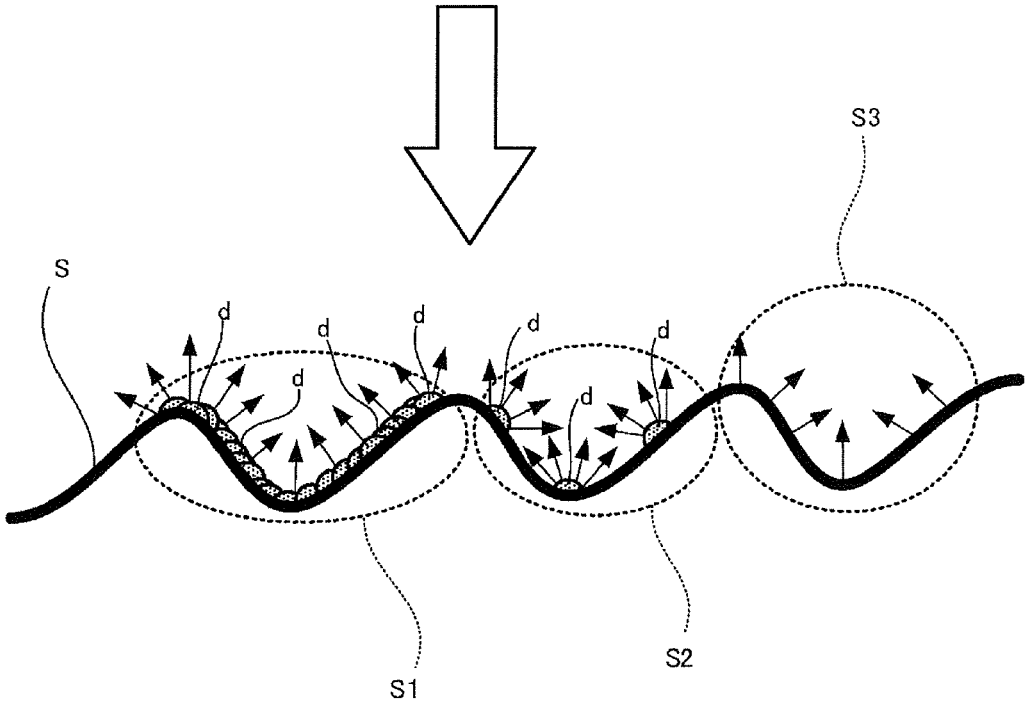
FIG. 8 is a view showing the principle for preventing uneven gloss using the printer in the present embodiment.

FIG. 8 shows the principle for preventing uneven gloss in the UV printer 1. A cross section of the medium S and ink drops "d" deposited on the medium S are shown in the drawing. The principle for preventing uneven gloss in the present example involves deforming the medium S so that an irregular shape in cross section is physically formed before the medium S is conveyed to the print area, as shown in the drawing. Incident light (white arrow in the drawing) is thereby diffusely reflected (solid arrows in the drawing) and a high-density, glossy image area S1 becomes matte in the same manner as the low-density, matte area S2 even when the ink drops "d" deposited on the irregular surface are in the glossy area S1. In addition, physical irregularities can be formed in the same manner even in an area S3 in which there are no ink drops "d" and in which the surface of the medium S is exposed, allowing light reflected from the surface of the medium S to be diffused. As a result, the entire image is made uniformly matte without uneven gloss. FIG. 8 is designed to describe, in simplified form, the principle for preventing uneven gloss, and the relative size of the ink drops "d" and the irregularities on the medium S is substantially different from the actual size.

FIG. 9 shows the operation of the medium-deforming unit 60 in the UV printer 1. In the example shown in the drawing, a pair of rollers (61, 62) for sandwiching the medium S from above and below is provided upstream of the conveying roller 22 on the conveying route "r" of the medium S. Physical irregularities are formed on the surface of one of the rollers, 61. The medium-deforming unit 60 comprises the roller (medium-deforming roller) 61 provided with irregularities, the driven roller 62 for holding the medium S together with the medium-deforming roller 61, a motor for rotatably driving the medium-deforming roller 61 by the control of the controller 10, and the like. The size of the irregularities on the medium-deforming roller 61 is expressed in an exaggerated manner in FIG. 9 in order to simplify the description.

Figure 9A:
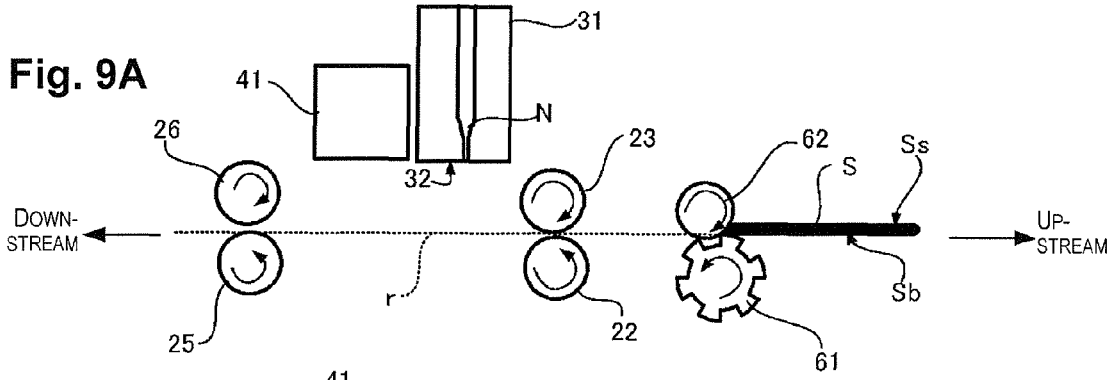
FIG. 9 is a view showing the operation of a function for preventing uneven gloss in the printer of the embodiment.
Figure 9B:
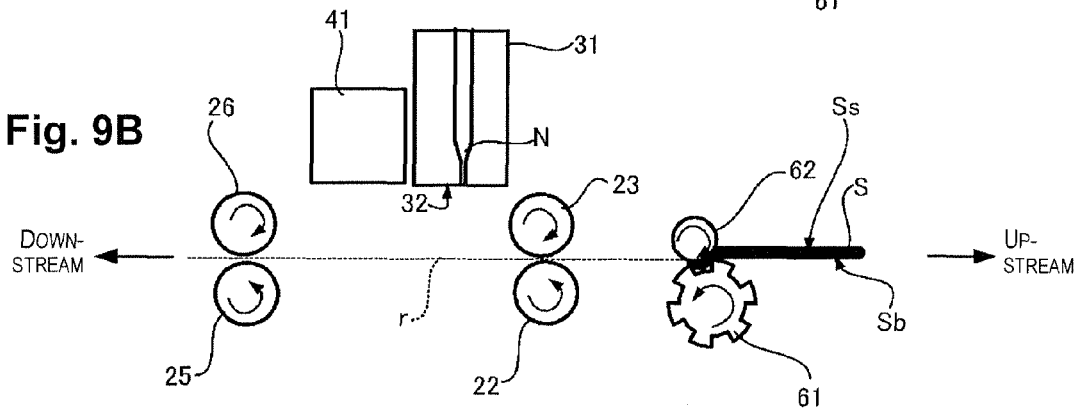
Figure 9C:
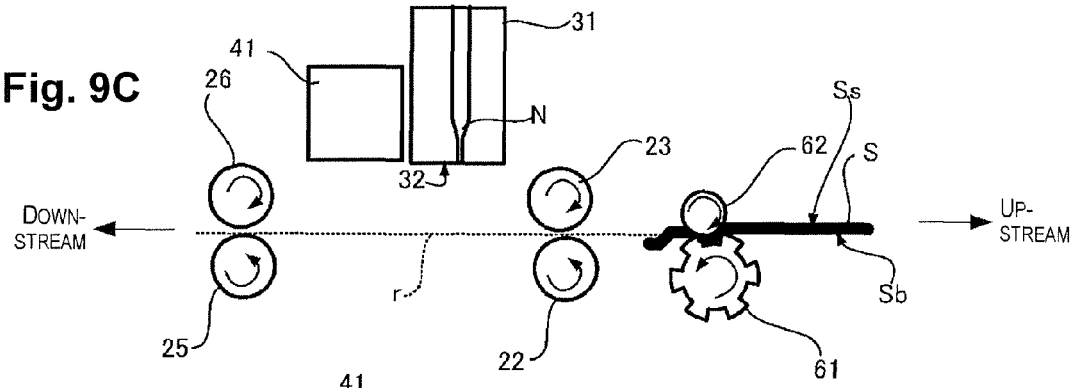
Figure 9D:
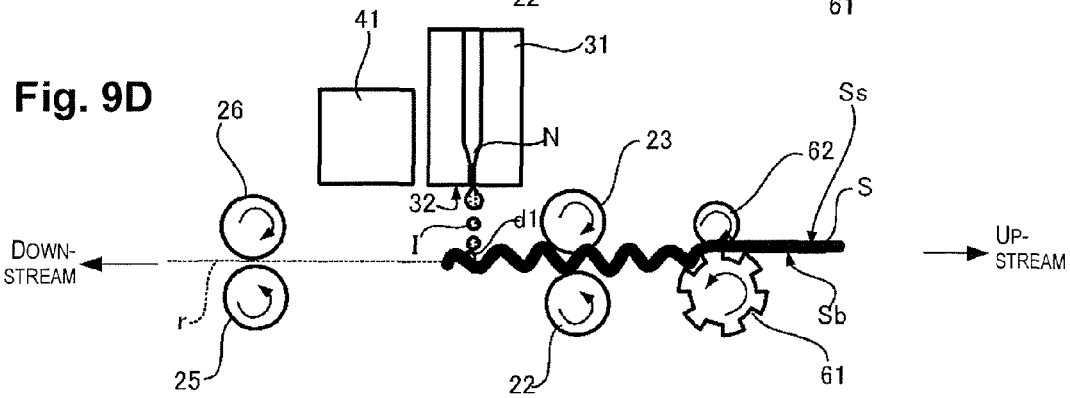

As shown in FIGS. 9A to 9C, the medium S first passes between the medium-deforming roller 61 and the driven roller 62 before being conveyed to the print area that faces the lower surface of the head 31 and the UV light source 41. At this time, the medium S is pressed against the surface of the medium-deforming roller 61, and the medium S is deformed into a shape provided with physical irregularities in cross section.

The ink I is discharged toward the upper surface (front surface) Ss of the deformed medium S, and the ink drops d1 are deposited on the medium S (D). The ink drops d1 on the medium S are then irradiated with ultraviolet light L and cured, and the medium S is ultimately released.

A metal roller provided with irregularities on the surface by machining can be used as the medium-deforming roller 61; a plastic molded article can also be used. In the present example, a metal roller is used in which the surface of the roller is etched and minute irregularities are formed in the surface of the roller in order to make the irregular shape of the medium less structured.

The driven roller 62 for holding the medium S together with the medium-deforming roller 61 can be a roller similar to the medium-deforming roller 61, but is more preferably a roller in which the surface of the metal roller is coated with, for example, a flexible material such as silicone rubber so as to be able to press down on the medium S while following the irregular shape of the medium-deforming roller 61. It is apparent that irregularities can also be present on the flexible surface of the driven roller.

The medium-deforming roller 61 can be arranged against the medium S on the front surface Ss or the rear surface Sb, but a case is considered in the present example in which a surface treatment (gloss treatment, matte treatment, or the like) is performed on the front surface Ss of the medium S on which ink drops "d" are deposited to form an image, and the driven roller 62 is arranged on the front surface Ss of the medium S. Conditions are thereby created in which the front surface Ss of the medium S on which an image is formed is directly pressed by the medium-deforming roller 61, and the coating or the like formed by the surface treatment is not damaged. As long as the actual depth of the irregularities on the medium S is about the size (diameter) of the ink drops "d", the ink drops form a film shape on a solidly printed or otherwise highly glossy area. Even when this happens, the surface of the film becomes irregularly shaped, the gloss level decreases, and a matte appearance is obtained. In the present example, the size of the ink drops "d" is about 1 μm, and the depth of the irregularities provided to the medium S is also about 1 μm. It is apparent that the depth and pitch of the irregularities formed on the medium S are set in a suitable manner in correspondence with the viscosity that contributes to the size and shape of the ink drops "d," and other characteristics of the ink drops and ink.

Other Embodiments

Among printers that use light-curable ink, there are types that perform "temporary curing," that is, perform a process in which ink drops are irradiated with low-energy light immediately after deposition to cure the surface of the ink drops in order to prevent the flow of ink until the ink drops deposited on the medium are fixed by high-energy light irradiation. Temporary curing is very effective for the purpose of preventing bleeding, but the uneven gloss described above can become more pronounced.

Specifically, the ink drops d1 deposited on the medium S in the UV printer 1 of this embodiment are irradiated with high-energy ultraviolet light, hardened, and fixed to the medium S, as shown in FIG. 7 above. On the other hand, the head 31 and the UV light source 41 must be arranged at a certain distance from each other in the UV printer 1 because clogging can occur in the nozzles N when the lower surface 32 of the head 31 is irradiated with ultraviolet light from the UV light source 41, the ultraviolet light containing light reflected from the medium S. A gap for accommodating a light-blocking structure is required when the blocking structure is interposed between the head 31 and the UV light source 41. Accordingly, the just-deposited ink drops d1 flow to a certain extent until the medium S is conveyed and the ink is irradiated by ultraviolet light, making the ink drops d1 lower than immediately after deposition. Specifically, the result is a flatter shape than immediately after deposition.

Conversely, in temporary-curing printers, stronger light diffusion occurs in areas having low ink-drop density because the ink drops on the medium preserve the shape obtained immediately after deposition. Accordingly, deforming the medium so as to have an irregular shape in cross-section allows even greater effectiveness in preventing uneven gloss to be obtained in temporary-curing printers.

The UV printer 1 according to this embodiment is a line printer, but can be a serial printer. Specifically, a serial printer can have a configuration in which the head moves in a direction intersecting with the conveying direction, rather than a configuration in which the head is arranged in the line direction across the width of the medium.

In the UV printer 1 according to this embodiment, an example is given of a piezo inkjet printer in which voltage is applied to a driving element (piezo element) to spray fluid by causing the expansion and contraction of an ink chamber, but the method for discharging fluid is not limited to this example, and a thermal inkjet printer can also be used in which bubbles are formed in the nozzles using a heater element, and liquid is sprayed by the bubbles.

In addition, in each of the printers according to the various embodiments of the invention, beginning with the UV printer 1 according to this embodiment, the medium is not limited to paper, and a plastic film or another medium having any form can be a print target as long as the irregular shapes applied prior to printing are maintained. It is apparent that the medium can be of a continuously conveyed form such as rolled paper, and can be of an individually conveyed form such as a single sheet of paper.

The conveying direction of the medium is such that the side on which the medium is supplied is the upstream side, and the side on which the medium is released is the downstream side, but the conveying direction is not limited to a unidirectional configuration from upstream to downstream. As shown, for example, in FIG. 4, a case is also possible in which the medium is supplied from the front side and is released from the same front side after printing. In such a case, a structure is preferably adopted in which the medium-deforming roller 61 and the driven roller 62 can hold and release the medium, and the controller 10 preferably controls the hold and release operations. The control procedure is preferably such that the medium S is held when supplied, and is not held in the process of being ejected after an image is formed. In any case, the medium S is preferably deformed so as to have an irregular shape in cross section after the image is formed on the medium. In any case, the medium should have an irregular shape in cross section before being conveyed to the print area.

INDUSTRIAL APPLICABILITY

The invention can be applied to inkjet printers for forming images using light-curable ink on, for example, media (OHP sheet, coated paper, and the like) that usually has low ink penetration.

What is claimed is:

1. A printing apparatus for depositing ink droplets on a surface of a medium to form an image, the printing apparatus comprising:

a medium-conveying part; nozzles; a light-irradiation part; a medium-deforming part; and a controller configured to control the parts, the medium-conveying part being configured to convey the medium so that the medium supplied from an upstream side is released on a downstream side, the nozzles being configured to discharge ink droplets curable by light irradiation onto the medium, the light-irradiation part being configured to irradiate the medium with light, the medium-deforming part being arranged on the upstream side of the nozzles, and being configured to hold the medium from the front and back and deform the medium so that an irregular shape is formed in cross section, the medium-deforming part being configured from rollers for holding the medium while being orthogonal to the conveying direction of the medium, and irregularities being formed on the surface of one of the rollers, the controller being configured to perform a medium-deforming step, an image-forming step, and a light-irradiating step, in the medium-deforming step, the medium being conveyed downstream by the medium-conveying part after the medium is deformed by the medium-deforming part, in the image-forming step, the ink droplets being discharged by the nozzles to form an image on the surface of the medium, and in the light-irradiating step, the ink droplets discharged onto the medium being irradiated with light by the light-irradiation part to cure the droplets, the surface of the medium on which the ink droplets are deposited being the front surface, the roller provided with irregularities being arranged facing the rear surface of the medium, and the roller provided with an elastic surface and formed from a material lacking any irregularities being arranged facing the front surface.

2. The printing apparatus according to claim 1, wherein:

the light-irradiation part arranged downstream of a head part further includes a temporary-curing irradiation part on the upstream side, and a permanent-curing irradiation part on the downstream side, the controller performs a temporary curing step and a permanent curing step, the temporary-curing irradiation part irradiates light for preventing the flow of the ink droplets, the permanent-curing irradiation part irradiates light having higher energy in comparison with the light irradiated by the temporary-curing irradiation part, in the temporary curing step, the ink droplets deposited on the medium by the nozzles are irradiated with light by the temporary-curing irradiation part, and in the permanent curing step, the ink droplets irradiated with light in the temporary curing step are irradiated with light, cured, and fixed to the medium.

3. The printing apparatus according to claim 1, further comprising a feeding unit configured to feed the medium into the printing apparatus, the feeding unit being arranged upstream relative to the medium-deforming part in the conveying direction.

4. A printing apparatus for depositing ink droplets on a surface of a medium to form an image, the printing apparatus comprising:

a medium-conveying part; nozzles; a light-irradiation part; a medium-deforming part; and a controller configured to control the parts, the medium-conveying part being configured to convey the medium so that the medium supplied from an upstream side is released on a downstream side, the nozzles being configured to discharge ink droplets curable by light irradiation onto the medium, the light-irradiation part being configured to irradiate the medium with light, the medium-deforming part being arranged on the upstream side of the nozzles, and being configured to hold the medium from the front and back and deform the medium so that an irregular shape is formed in cross section, the medium-deforming part including a first roller and a second roller facing the first roller in a first direction, the first roller having at least one projecting part projecting outward from an outer circumference of the first roller and extending along a second direction perpendicular to the first direction and the conveying direction of the medium, the at least one projecting part extending straight along the second direction, the controller being configured to perform a medium-deforming step, an image-forming step, and a light-irradiating step, in the medium-deforming step, the medium being conveyed downstream by the medium-conveying part after the medium is deformed by the medium-deforming part, in the image-forming step, the ink droplets being discharged by the nozzles to form an image on the surface of the medium, and in the light-irradiating step, the ink droplets discharged onto the medium being irradiated with light by the light-irradiation part to cure the droplets, the controller being further configured to control the at least one projecting part to be pressed against the medium while the first roller and the second roller hold the medium therebetween in the medium-deforming step.

5. A printing method for printing a medium by using a printing apparatus, the printing method comprising:

conveying the medium in a conveying direction;

forming an image composed of minute dots on the medium by discharging light-curable ink as droplets from nozzles, depositing the light-curable ink on the medium, and irradiating and curing the droplets deposited on the medium with light; and deforming the medium by a medium-deforming part being arranged upstream relative to the nozzles in the conveying direction so that an irregular shape is formed in cross section before the forming of the image on the medium, the printing apparatus including the nozzles and the medium-deforming part, the medium-deforming part including a first roller and a second roller facing the first roller in a first direction, the first roller having at least one projecting part projecting outward from an outer circumference of the first roller and extending along a second direction perpendicular to the first direction and the conveying direction, the at least one projecting part extending straight along the second direction, the deforming of the medium including holding the medium between the first roller and the second roller and pressing the at least one projecting part against the medium.

6. The printing method according to claim 5, further comprising feeding the medium into the printing apparatus by a feeding unit that the printing apparatus further includes, the feeding unit being arranged upstream relative to the medium-deforming part in the conveying direction, the deforming of the medium being performed after the feeding of the medium.

* * * * *